United States Patent [19]

Takahashi

[11] 4,173,716

[45] Nov. 6, 1979

[54] MICROWAVE HEATING APPARATUS

[75] Inventor: Hirokazu Takahashi, Tokyo, Japan

[73] Assignee: Tokyo Shibaura Electric Co., Ltd., Kanagawa, Japan

[21] Appl. No.: 817,039

[22] Filed: Jul. 19, 1977

[30] Foreign Application Priority Data

Jul. 20, 1976 [JP] Japan ..... 51/86353

[51] Int. Cl.[2] ..... H05B 9/06

[52] U.S. Cl. ..... 219/10.55 F

[58] Field of Search ..... 219/10.55 R, 10.55 F, 219/10.55 D, 10.55 B

[56] References Cited

U.S. PATENT DOCUMENTS

| | | | |
|---|---|---|---|
| 2,909,635 | 10/1959 | Haagensen | 219/10.55 F |
| 3,819,900 | 6/1974 | Ironfield | 219/10.55 F |
| 3,909,754 | 9/1975 | Chapell | 219/10.55 F |

*Primary Examiner*—Arthur T. Grimley

*Attorney, Agent, or Firm*—Oblon, Fisher, Spivak, McClelland & Maier

[57] ABSTRACT

A microwave heating apparatus comprising an oven cavity, a magnetron connected with the oven cavity through a waveguide, an electromagnetic wave mode stirrer provided in the oven cavity, and a frequency pulling generator located in the waveguide and moving independently of the movement of the electromagnetic wave mode stirrer.

18 Claims, 2 Drawing Figures

MICROWAVE HEATING APPARATUS

BACKGROUND OF THE INVENTION

This invention relates to a microwave heating apparatus such as a microwave oven.

A microwave heating apparatus e.g. a microwave oven has usually an oven cavity containing an object being heated and a waveguide located on the outside of the upper wall (ceiling) of the oven cavity. One end of the waveguide is connected with a microwave inlet opening at the upper wall of the oven cavity, and the other end is connected with a magnetron which serves as a microwave emanating source. At the bottom portion of the oven cavity is provided a rack to put the object being heated such as food. In operation, a microwave is transmitted from the magnetron into the oven cavity through a waveguide and the object is heated.

In the oven thus constructed, the electromagnetic wave becomes a standing wave which causes the non-uniform heating of the object to be heated in it. In order to make a uniform heat pattern there are usually utilized some devices in which (a) an electromagnetic wave mode stirrer is installed on the oven ceiling for stirring the standing wave, by changing the reflection of the electromagnetic wave, or (b) a turntable is installed on the oven bottom for turning the object on it or (c) both stirrer and turntable are installed. However, these methods are not necessarily sufficient for good uniformity in heating, and furthermore, heating an object turned on a turntable in an oven cavity is sometimes inconvenient. There is a known method which has a stirrer in a waveguide coupling section and coaxially arranged with an electromagnetic wave mode stirrer in an oven cavity. The effect of this method is limited since the electromagnetic mode change is similar to that due to the complete synchronization between two stirrers.

SUMMARY OF THE INVENTION

The object of this invention is to improve the heating uniformity in a microwave oven cavity.

The microwave heating apparatus according to this invention comprises a means for stirring the electromagnetic field in the oven or an electromagnetic wave mode stirrer, and a frequency pulling generator constructed in a waveguide which causes the frequency change of the magnetron oscillation by the pulling phenomenon, and the movements of the both means are independent of each other. This invention is the application of the phenomenon called "frequency pulling" e.g. the oscillating frequency changes with the load impedance to which a magnetron oscillator is connected. Thus, a feature of the microwave heating apparatus of this invention is that it has a frequency pulling generator which moves independently against the electromagnetic wave mode stirrer or the turntable on which the object to be heated is to be put. The principle of operation is explained below.

A magnetron oscillates in a unique frequency in relation to the load impedance as is usually shown in the Rieke diagram. The oscillation frequency change caused by the impedance change in a waveguide which is directly coupled to a magnetron can be made very large, and this frequency change in turn, causes wide standing wave mode variation in a oven cavity, and furthermore, the electromagnetic wave mode stirrer in the oven cavity which moves independently with this impedance change in the waveguide causes additional standing wave mode change in the oven cavity. These two independently caused standing wave mode changes make more even uniformity in heating than only an electromagnetic mode stirrer or a turntable does. Assuming the number of the standing wave mode to be $n_s$, and assuming the number of frequency changes due to the frequency pulling generator to be $n_f$ (though $n_s$ and $n_f$ are infinite numbers they are assumed to be discrete and finite in order to make explanation simple), the total numbers N of the states corresponding to standing wave modes generated in the oven cavity are $n_f$ or $n_f$ whichever larger, since the oscillation frequency of the magnetron is determined by the impedance to which the standing wave mode is uniquely corresponding. Even though there is installed a frequency pulling generator in the waveguide which rotates in synchronization with an electromagnetic wave mode stirrer in the oven cavity as previously described, N is still $n_s$ or $n_f$ whichever larger.

With this invention, however, N becomes $n_s \times n_f$ which is obviously larger than that obtained in the prior art, because the oscillating frequency of the magnetron is determined by the frequency pulling generator in the waveguide independently of the electromagnetic wave mode stirrer in the oven cavity.

BRIEF DESCRIPTON OF THE DRAWING

DETAILED DESCRIPTION OF PREFERED EMBODIMENT

Figure 1:
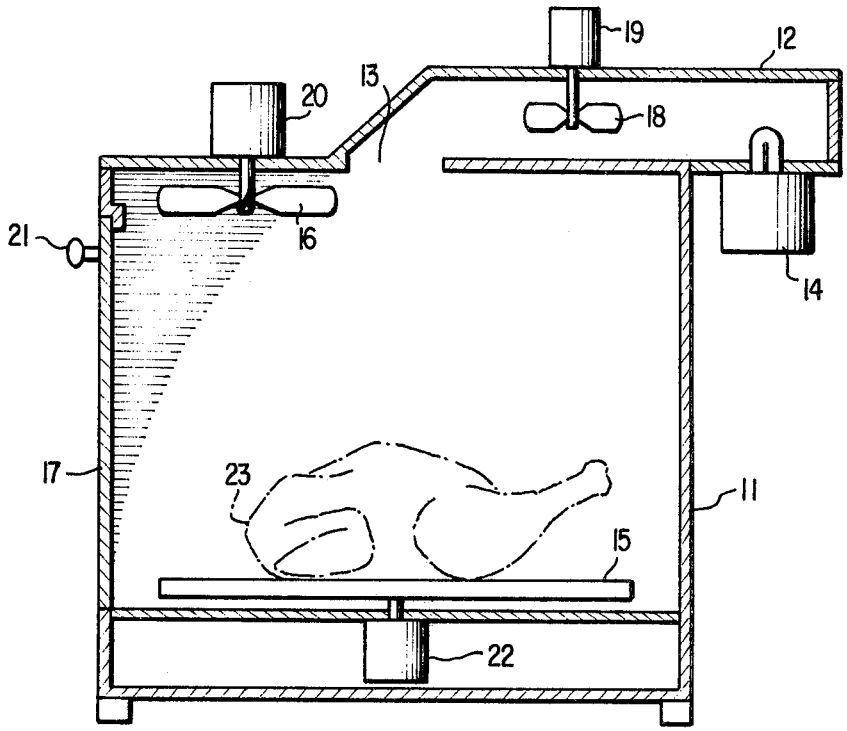
FIG. 1 is a schematic view of a microwave heating apparatus of this invention.
Figure 2:
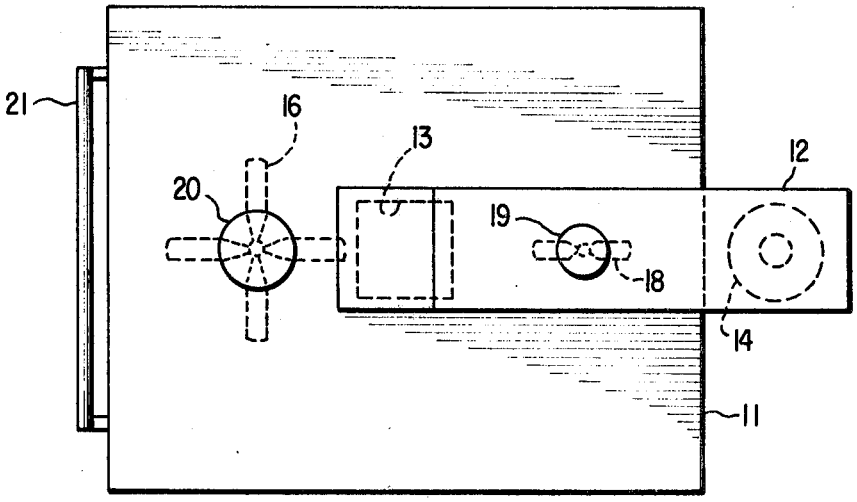
FIG. 2 is a top view of FIG. 1.

FIG. 1 shows a microwave oven as a popular microwave apparatus according to an embodiment of this invention. As illustrated in FIG. 1, the microwave oven of this invention comprises an oven cavity 11, and a rectangular waveguide 12 disposed on an outer surface of the ceiling plate of the cavity 11, whose one end is connected to a microwave coupling windows or inlet 13 on the ceiling plate. At the front of the oven cavity 11 is a door 17 having a grip 21 to take in and out an object to be heated. A magnetron 14 as a microwave oscillator is connected to another end of the waveguide 12. Furthermore, a rotator 18 is disposed in the waveguide 12 and rotated by a motor 19, so as to cause frequency pulling. In this case, the rotator 18 is made of conductor or ferroelectric material, formed into wing shape and disposed in the waveguide 12 with an axis so as to be able to be rotated. The rotator 18 is set to be rotated 60 revolutions per minute without synchronizing with rotation of the stirrer fan 16 in the cavity 11, that is the rotator 18 or the stirrer fan 16 is driven independently by an independent motor. The rotator 18 does not directly affect the electromagnetic field in the cavity 11, but affects the electromagnetic field in the waveguide 12. On the other hand, the electromagnetic field stirrer fan 16 having four conductive wings is rotated 300 revolutions per minute and thereby directly changes the electromagnetic field pattern in the cavity 11 every moment. Also there is a shelf plate or a rack, 15 in the bottom of the cavity 11 for a food vessel. The shelf plate 15 may be rotated by a motor 22 holding the food to be heated 23.

The microwave apparatus of this invention composed in the above mentioned way can offer excellent heating uniformity, since the electromagnetic field pattern in the cavity 11 changes more widely than the electromagnetic field pattern in a conventional oven does owing to the stirrer fan 16 in the cavity 11 and the rotator 18 in the waveguide 12 which is rotated in the mode independent of that of the stirrer fan 16. The inventor has carried out an experiment concerning this invention and the results are as follows.

This experiment was carried out using a magnetron whose oscillation frequency is 2450MH$_z$. Sixteen thermally isolated cells made of dielectric were filled with water of initial temperature 20° C. and put in an oven cavity. The temperature of water in each cell was immediately measured after being radiated with microwave power of about 600 watts during 120 seconds. The highest temperature of water in sixteen cells was 49° C., the lowest temperature was 44° C. and the average temperature was 46.8° C. when heat was applied with this invention. The definition of heating unevenness is given as $$\frac{\text{maximum temperature rise} - \text{minimum temperature rise}}{\text{average temperature rise}} \times 100\ (\%)$$

Then the heating uneveness in this experiment is 18.6%. On the other hand, heating unevenness occurring in a microwave apparatus of conventional type (no means to cause frequency pulling independently) was 42%. As this experiment shows, heating uniformity in a microwave apparatus of this invention is greatly improved. In this embodiment of this invention, means to cause frequency pulling (a rotator), or a stirrer fan is driven by a motor, however they may be also driven by cooling air flow of a magnetron.

Means to cause frequency pulling is favourably disposed in position where the frequency pulling most effectively occurs. This position may be an r.f. coupling window of an oven cavity where a waveguide is connected. Moreover, this means to cause frequency pulling is not restricted to wing shape form, but also may be formed into slab shape or sphere shape. These means may be driven by vibration or reciprocation, and they may be also drived by cooling air flow of a magnetron guided into a waveguide.

It is desirable to move the means for stirring the electromagnetic field as widely as possible in whole cavity space, and a turntable on which food is held may be used instead of a stirrer fan.

As a more favorable embodiment, the waveguide is branched off halfway to supply a microwave into the plural position of the oven cavity, and a frequency pulling generator is disposed in each branched waveguide. Here each frequency pulling generator is rotated or vibrated or reciprocated independently. Thereby the heating uniformity in this embodiment is excellent.

As described above, this invention can offer a microwave heating apparatus whose heating unevenness is effectively eliminated.

What is claimed as new and desired to be secured by Letters Patent of the United States is:

1. A microwave heating apparatus for heating an object comprising:

an oven enclosure having a microwave coupling inlet;

a magnetron for generating a microwave at the oscillating frequency of the magnetron;

a waveguide having one end connected to the microwave coupling inlet and the other end connected to the magnetron for transmitting a microwave from the magnetron into the oven enclosure;

drivable means disposed inside the oven enclosure for stirring the pattern of the electromagnetic field of the microwave transmitted into the oven enclosure;

drivable means disposed inside the waveguide for frequency pulling the oscillating frequency of the magnetron; and means for driving the frequency pulling means independently of the stirring means.

2. The microwave heating apparatus recited in claim 1 wherein the driving means comprises an electric motor.

3. The microwave heating apparatus recited in claim 1 wherein the driving means comprises flowing air.

4. The microwave heating apparatus recited in claim 1 wherein the driving means comprises:

a first motor for driving the frequency pulling means; and a second motor for driving the stirring means; and means for rotating the first and second motors separately so that their rates of rotation differ from each other.

5. The microwave heating apparatus recited in claim 1 wherein each of the stirring means and the frequency pulling means has at least one wing of ferroelectric material.

6. The microwave heating apparatus recited in claim 1 wherein each of the stirring means and the frequency pulling means has a plurality of wings of ferroelectric material and the wings of the frequency pulling means are fewer than those of the stirring means.

7. The microwave heating apparatus recited in claim 1 wherein the stirrer means comprises a rotatable holder for the object to be heated.

8. The microwave heating apparatus recited in claim 1 wherein the frequency pulling means is reciprocatable.

9. A microwave heating apparatus comprising an oven cavity, a waveguide, a magnetron connected with the oven cavity through the waveguide, and a electromagnetic wave mode stirrer, wherein a frequency pulling generator to vary the oscillating frequency of the magnetron by the aid of frequency pulling phenomenon is provided in the waveguide and moves independently of the movement of the electromagnetic wave mode stirrer.

10. A microwave heating apparatus according to claim 9, wherein the electromagnetic wave mode stirrer and the frequency pulling generator are driven mutually independently by an electric motor or a flowing air.

11. A microwave heating apparatus according to claim 9, wherein the frequency pulling generator is driven by a flowing air which cools the magnetron.

12. A microwave heating apparatus according to claim 9, wherein both the electromagnetic wave mode stirrer and the frequency pulling generator have motors respectively and are rotated separately so that their rates of rotation differ from each other.

13. A microwave heating apparatus according to claim 9, wherein both the electromagnetic wave mode stirrer and frequency pulling generator have a wing of ferroelectric material.

14. A microwave heating apparatus according to claim 13, wherein the wings of the frequency pulling generator are fewer than that of the electromagnetic wave mode stirrer.

15. A microwave heating apparatus according to claim 9, wherein the electromagnetic wave mode stirrer rotates holding the object being heated.

16. A microwave heating apparatus according to claim 9, wherein the frequency pulling generator moves reciprocately.

17. A microwave heating apparatus according to claim 9, wherein the waveguide is branched off and each of the branched waveguides comprises a frequency pulling generator therein.

18. A microwave heating apparatus according to claim 17, wherein a plurality of frequency pulling generators in the branched waveguides and the electromagnetic wave mode stirrer in the oven cavity move independently of one another.

* * * * *